US011359155B2

(12) United States Patent
Brewer et al.

(10) Patent No.: US 11,359,155 B2
(45) Date of Patent: Jun. 14, 2022

(54) USE OF A WAX ANTI-SETTLING ADDITIVE IN AUTOMOTIVE FUEL COMPOSITIONS

(71) Applicant: SHELL OIL COMPANY, Houston, TX (US)

(72) Inventors: Mark Lawrence Brewer, Amsterdam (NL); Nicholas James Rounthwaite, London (GB); Michael Alan Parkes, London (GB); Tushar Bera, Fulshear, TX (US)

(73) Assignee: SHELL USA, INC., Houston, TX (US)

( * ) Notice: Subject to any disclaimer, the term of this patent is extended or adjusted under 35 U.S.C. 154(b) by 112 days.

(21) Appl. No.: 16/303,522

(22) PCT Filed: May 19, 2017

(86) PCT No.: PCT/EP2017/062187

§ 371 (c)(1),
(2) Date: Nov. 20, 2018

(87) PCT Pub. No.: WO2017/202735

PCT Pub. Date: Nov. 30, 2017

(65) Prior Publication Data

US 2020/0325410 A1 Oct. 15, 2020

Related U.S. Application Data

(60) Provisional application No. 62/340,007, filed on May 23, 2016.

(51) Int. Cl.
*C10L 9/10* (2006.01)
*C10L 1/188* (2006.01)
(Continued)

(52) U.S. Cl.
CPC ..... *C10L 9/10* (2013.01); *C10L 1/1883* (2013.01); *C10L 1/1895* (2013.01); *C10L 10/04* (2013.01);
(Continued)

(58) Field of Classification Search
CPC ..... C10L 9/10; C10L 1/1895; C10L 1/1883; C10L 10/04; C10L 2270/026; C10L 2200/0446; C10L 2200/0259
See application file for complete search history.

(56) References Cited

U.S. PATENT DOCUMENTS 3,387,954 A * 6/1968 Capowski ..... C10L 1/222 44/422
4,125,566 A 11/1978 Trin Dinh et al.
(Continued)

FOREIGN PATENT DOCUMENTS

CA 2840524 A1 1/2013
CA 2859182 A1 6/2013
(Continued)

OTHER PUBLICATIONS

Disclosed Anonymously, Additive for diesel fuel applications, Research Disclosure, Kenneth Mason Publications, Jun. 2008, pp. 1-4 (Year: 2008).*
(Continued)

*Primary Examiner* — Cephia D Toomer
(74) *Attorney, Agent, or Firm* — Shell USA, Inc.

(57) ABSTRACT

Use of a wax anti-settling agent (WASA), in an automotive fuel composition, for the purpose of improving the acceleration performance of an internal combustion engine into which the fuel composition is or is intended to be introduced or of a vehicle powered by such an engine.

12 Claims, 5 Drawing Sheets

(51) Int. Cl.
*C10L 1/189* (2006.01)
*C10L 10/04* (2006.01)

(52) U.S. Cl.
CPC ..... *C10L 2200/0259* (2013.01); *C10L 2200/0446* (2013.01); *C10L 2270/026* (2013.01)

(56) References Cited

U.S. PATENT DOCUMENTS

| | | | | |
|---|---|---|---|---|
| 4,208,190 | A | 6/1980 | Malec | |
| 4,478,955 | A | 10/1984 | Pesa et al. | |
| 5,490,864 | A | 2/1996 | Herbstman et al. | |
| 5,879,418 | A | 3/1999 | Webster, III | |
| 7,638,661 | B2 | 12/2009 | Davenport et al. | |
| 7,951,211 | B2 | 5/2011 | Barton et al. | |
| 8,236,741 | B2 | 8/2012 | Poirier et al. | |
| 8,915,977 | B2 | 12/2014 | Fang et al. | |
| 9,062,265 | B2 | 6/2015 | Reid et al. | |
| 9,222,047 | B2 | 12/2015 | Brewer | |
| 9,574,149 | B2 | 2/2017 | Fang et al. | |
| 9,677,020 | B2 | 6/2017 | Fang et al. | |
| 2005/0138859 | A1* | 6/2005 | Jackson | C10L 1/143 44/389 |
| 2006/0162238 | A1* | 7/2006 | Schwab | B01D 19/0409 44/320 |
| 2009/0241882 | A1* | 10/2009 | Brunner | C10L 1/165 123/1 A |
| 2012/0010112 | A1* | 1/2012 | Grabarse | C10L 1/22 508/291 |
| 2014/0238328 | A1 | 8/2014 | Fang | |
| 2015/0113858 | A1 | 4/2015 | Brewer | |
| 2015/0166920 | A1 | 6/2015 | Brewer | |
| 2015/0266808 | A1 | 9/2015 | Hansch et al. | |
| 2016/0108331 | A1* | 4/2016 | Voelkel | C10L 10/08 44/399 |

FOREIGN PATENT DOCUMENTS

| | | | |
|---|---|---|---|
| CA | 2863698 | A1 | 8/2013 |
| CN | 101200660 | A | 6/2008 |
| CN | 103249757 | A | 8/2013 |
| CN | 104513678 | A | 4/2015 |
| CN | 104845687 | A | 8/2015 |
| EP | 0147240 | A2 | 7/1985 |
| EP | 0147873 | A1 | 7/1985 |
| EP | 0482253 | A1 | 4/1992 |
| EP | 0557516 | A1 | 9/1993 |
| EP | 0583836 | A1 | 2/1994 |
| EP | 0613938 | A1 | 9/1994 |
| EP | 1947161 | A1 | 7/2008 |
| EP | 2033945 | * | 3/2009 |
| EP | 2257614 | A2 | 12/2010 |
| GB | 960493 | A | 6/1964 |
| GB | 2077289 | A | 12/1981 |
| GB | 2493377 | A | 2/2013 |
| JP | 2008150605 | A | 7/2008 |
| JP | 2011508036 | A | 3/2011 |
| JP | 2013532163 | A | 8/2013 |
| JP | 2014208752 | A | 11/2014 |
| WO | 9417160 | A1 | 8/1994 |
| WO | 9533805 | A1 | 12/1995 |
| WO | 9801516 | A1 | 1/1998 |
| WO | 9842808 | A1 | 10/1998 |
| WO | 2013117616 | A1 | 8/2013 |
| WO | 2015011506 | A1 | 1/2015 |
| WO | 2016016641 | A1 | 2/2016 |

OTHER PUBLICATIONS

International Search Report and Written Opinion received for PCT Patent Application No. PCT/EP2017/062187, dated Jul. 20, 2017, 9 pages.

Maithufi et al., "Application of Gemini Surfactants as Diesel Fuel Wax Dispersants", Energy & Fuels, vol. 25, Issue No. 1, Jan. 20, 2011, pp. 162-171, XP055389379.

Burgt et al., "The Shell Middle Distillate Synthesis Process" paper delivered at the 5th Synfuels Worldwide Symposium, Nov. 1985, pp. 204-210.

Wei et al., "The Lubricity of Diesel Fuels", Wear, vol. 111, Issue No. 2, Sep. 1, 1986, pp. 217-235.

* cited by examiner

% Acceleration benefit of Candidate Fuel C relative to Reference Fuel

% Power benefit of Candidate Fuel C relative to Reference Fuel

% Acceleration benefits of Candidate Fuels A- D relative to Reference Fuel

% Power benefits of Candidates Fuels A-D relative to Reference Fuel

USE OF A WAX ANTI-SETTLING ADDITIVE IN AUTOMOTIVE FUEL COMPOSITIONS

PRIORITY CLAIM

The present application is the National Stage (§ 371) of International Application No. PCT/EP2017/062187, filed May 19, 2017, which claims priority from U.S. Application No. 62/340,007, filed May 23, 2016 incorporated herein by reference.

FIELD OF THE INVENTION

The present invention relates to automotive fuel compositions and their use, and to methods for improving the performance of internal combustion engines, in particular diesel engines.

BACKGROUND OF THE INVENTION

It is known to use a viscosity increasing component in a fuel composition in order to improve acceleration performance. WO2009/118302 describes the use of a viscosity index (VI) improving additive, in an automotive fuel composition, for the purpose of improving the acceleration performance of an internal combustion engine into which the fuel composition is or is intended to be introduced or of a vehicle powered by such an engine.

In order to have a significant effect on fuel viscosity, and hence on engine performance, such VI improving additives typically need to be used at concentrations of at least 5% w/w, often higher. Some of them can however, in particular at higher concentrations, have a negative impact on other fuel properties, for example distillation or cold flow properties, potentially making it difficult to keep the resultant fuel composition within a desired specification. Further, VII additives can be expensive and therefore it is undesirable to use them at high levels.

It would be desirable to be able to further improve the performance of a vehicle engine, by altering the composition and/or properties of the fuel introduced into it, as this can be expected to provide a more simple, flexible and cost effective route to performance optimisation than by making structural or operational changes to the engine itself.

In particular, for the reasons given above, it would be desirable to further improve engine performance without having to use high levels of VII additives.

Fuel oils, whether derived from petroleum or from vegetable sources, contain components, e.g. n-alkanes or methyl n-alkanoates, that at low temperature tend to precipitate as large, plate-like crystals or spherulites or wax in such a way as to form a gel structure which causes the fuel to lose its ability to flow. The lowest temperature at which the fuel will still flow is known as the pour point.

As the temperature of a fuel falls and approaches the pour point, difficulties arise in transporting the fuel through lines and pumps. Further, the wax crystals tend to plug fuel lines, screens, and filters at temperatures above the pour point. These problems are well recognised in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily an alkane wax, crystallizes as platelets. Certain additives inhibit this and cause the wax to adopt an acicular habit, the resulting needles being more likely than platelets to pass through a filter or to form a porous layer of crystals on the filter. Other additives may also have the effect of retaining the wax crystals in suspension in the fuel, reducing settling and thus also assisting in preventing blockages. These types of additives are often termed "wax anti-settling additives" (WASAs) and are commonly polar nitrogen species.

EP-A-2033945 and EP-A-1947161 disclose certain quaternary ammonium salts of carboxylic acids which are useful as wax anti-settling agents (WASAs). Such wax anti-settling agents have not, however, to our knowledge, been proposed for use in improving the acceleration performance or the power output of an engine.

It has now been surprisingly found by the present inventors that wax anti-settling agents, such as those disclosed in EP-A-2033945 and EP-A-1947161, can surprisingly be used in a fuel composition to improve engine performance.

SUMMARY OF THE INVENTION

It has surprisingly been found that fuel compositions containing certain wax anti settling agents (WASAs) can give performance benefits in terms of improved acceleration and power. This is by no means predictable from the known uses of wax anti-settling agents.

Hence, according to a first aspect of the present invention there is provided the use of a wax anti-settling agent (WASA), in an automotive fuel composition, for the purpose of improving the acceleration performance of an internal combustion engine into which the fuel composition is or is intended to be introduced or of a vehicle powered by such an engine.

According to a second aspect of the present invention there is provided the use of a wax anti-settling agent (WASA), in an automotive fuel composition, for the purpose of improving the power output of an internal combustion engine into which the fuel composition is or is intended to be introduced or of a vehicle powered by such an engine.

The present invention further has the advantage that it enables the use of lower levels of expensive VII additives in fuel compositions in order to obtain desired levels of engine performance. This in turn can reduce the overall cost of the fuel preparation process. The use of lower concentrations of VI improving additives can also help to reduce any undesirable side effects—for example impacting on distillation or cold flow properties—caused by their incorporation into a fuel composition. In a preferred embodiment, the fuel composition herein is free of VII additives.

DRAWINGS

DETAILED DESCRIPTION OF THE INVENTION

Figure 1:
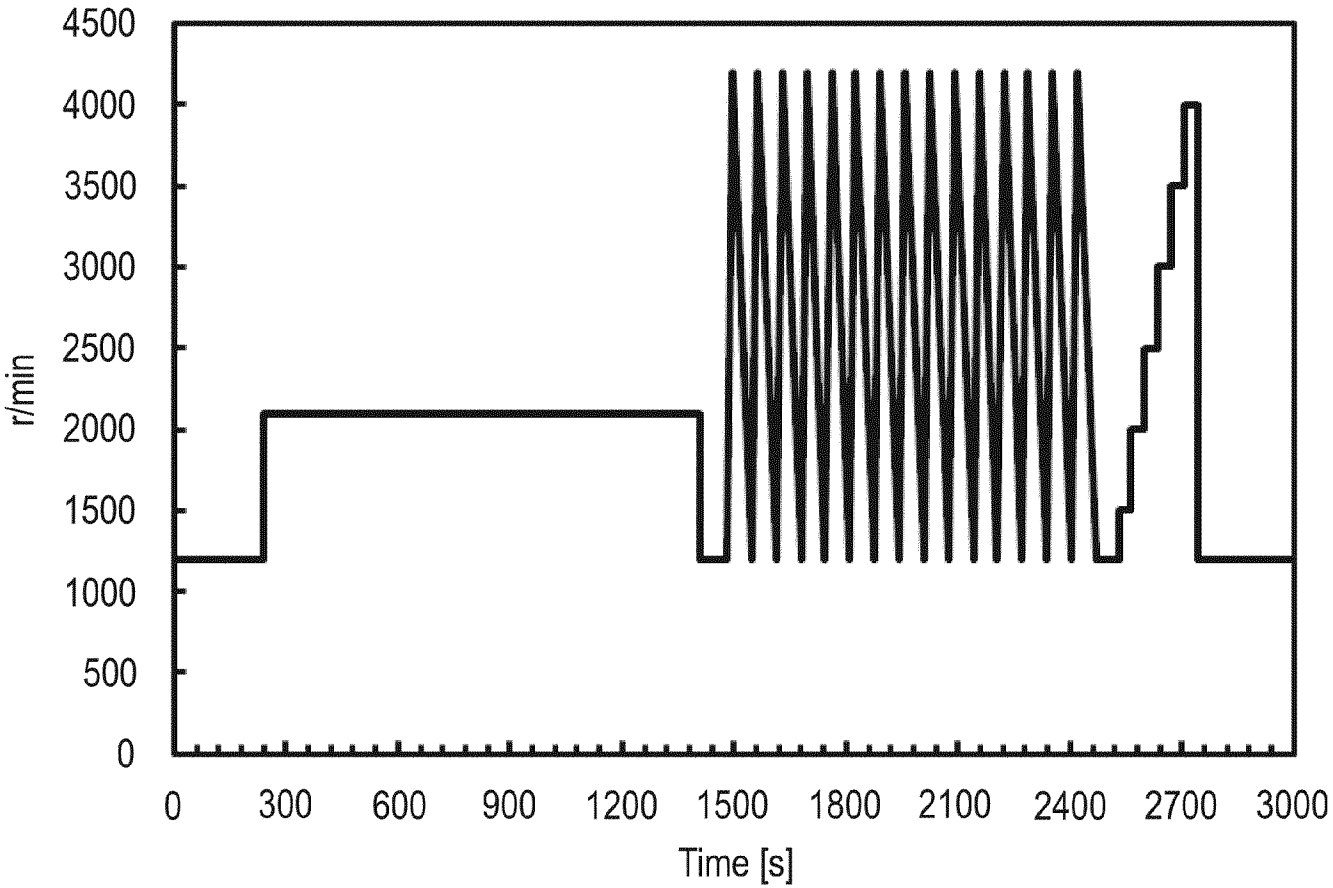
FIG. 1 shows the test sequence of the instantaneous power performance test which was carried out on Reference Fuel and Candidate Fuels A-D of the Examples.

The fuel composition is preferably a diesel fuel composition and the internal combustion engine is preferably a diesel engine.

By "diesel engine" is meant a compression ignition internal combustion engine, which is adapted to run on a diesel fuel.

"Acceleration performance" includes generally the responsiveness of the engine to increased throttle, for example the rate at which it accelerates from any given engine speed. It includes the level of power and/or torque and/or vehicle tractive effort (VTE) generated by the engine at any given speed. Thus an improvement in acceleration performance may be manifested by an increase in engine power and/or torque and/or VTE at any given speed.

Engine torque may be derived from the force exerted on a dynamometer by the wheel(s) of a vehicle which is powered by the engine under test. It may, using suitably specialised equipment (for example the Kistler™ RoaDyn™), be measured directly from the wheels of such a vehicle. Engine power may suitably be derived from measured engine torque and engine speed values, as is known in the art. VTE may be measured by measuring the force exerted, for example on the roller of a chassis dynamometer, by the wheels of a vehicle driven by the engine.

The present invention can be of use in improving the acceleration performance of an internal combustion engine or of a vehicle powered by such an engine. Acceleration performance may be assessed by accelerating the engine and monitoring changes in engine speed, power, torque and/or VTE, air charge pressure and/or turbo charger speed with time. This assessment may suitably be carried out over a range of engine speeds.

Acceleration performance may also be assessed by a suitably experienced driver accelerating a vehicle which is powered by the engine under test, for instance from 0 to 100 km/hour, on a road. The vehicle should be equipped with appropriate instrumentation such as an engine speedometer, to enable changes in acceleration performance to be related to engine speed.

In general, an improvement in acceleration performance may be manifested by reduced acceleration times, and/or by any one or more of the effects described above for example a faster increase in turbo charger speed, or an increase in engine torque or power or VTE at any given speed.

In the context of the present invention, an "improvement" in acceleration performance embraces any degree of improvement. Similarly a reduction or increase in a measured parameter—for example the time taken for the turbo charger to reach its maximum speed—embraces any degree of reduction or increase, as the case may be. The improvement, reduction or increase—as the case may be—may be as compared to the relevant parameter when using the fuel composition prior to incorporation of the wax anti-settling agent. It may be as compared to the relevant parameter measured when the same engine is run on an otherwise analogous fuel composition which is intended (e.g. marketed) for use in an internal combustion (typically diesel) engine, prior to adding a wax anti-settling agent to it.

The present invention may, for example, involve adjusting the properties and/or performance and/or effects of the fuel composition, in particular its effect on the acceleration performance of an internal combustion engine, by means of the wax anti-settling agent, in order to meet a desired target.

An improvement in acceleration performance may also embrace mitigation, to at least a degree, of a decrease in acceleration performance due to another cause, in particular due to another fuel component or additive included in the fuel composition. By way of example, a fuel composition may contain one or more components intended to reduce its overall density so as to reduce the level of emissions which it generates on combustion; a reduction in density can result in loss of engine power, but this effect may be overcome or at least mitigated by the use of a wax anti-settling agent in accordance with the present invention.

An improvement in acceleration performance may also embrace restoration, at least partially, of acceleration performance which has been reduced for another reason such as the use of a fuel containing an oxygenated component (e.g. a so-called "biofuel"), or the build-up of combustion related deposits in the engine (typically in the fuel injectors).

Where the present invention is used to increase the engine torque, typically during a period of acceleration, at a given engine speed, the increase may be of at least 0.1%, preferably of at least 0.2 or 0.3 or 0.4 or 0.5%, in cases of at least 0.6 or 0.7%, compared to that obtained when running the engine on the fuel composition prior to incorporation of the wax anti-settling agent. The increase may be as compared to the engine torque obtained at the relevant speed when the same engine is run on an otherwise analogous fuel composition which is intended (e.g. marketed) for use in an internal combustion (typically diesel) engine prior to adding a wax anti-settling agent to it.

Where the present invention is used to increase the engine power, typically during a period of acceleration, at a given engine speed, the increase may again be of at least 0.1%, preferably of at least 0.2 or 0.3 or 0.4 or 0.5%, in cases of at least 0.6 or 0.7%, compared to that obtained when running the engine on the fuel composition prior to incorporation of the wax anti-settling agent. The increase may be as compared to the engine power obtained at the relevant speed when the same engine is run on an otherwise analogous fuel composition which is intended (e.g. marketed) for use in an internal combustion (typically diesel) engine prior to adding a wax anti-settling agent to it.

Where the present invention is used to increase the engine VTE, typically during a period of acceleration, at a given engine speed, the increase may again be of at least 0.1%, preferably of at least 0.2 or 0.3 or 0.4 or 0.5%, in cases of at least 0.6 or 0.7%, compared to that obtained when running the engine on the fuel composition prior to incorporation of the wax anti-settling agent. The increase may be as compared to the VTE obtained at the relevant speed when the same engine is run on an otherwise analogous fuel composition which is intended (e.g. marketed) for use in an internal combustion (typically diesel) engine prior to adding a wax anti-settling agent to it.

Where the present invention is used to reduce the time taken for the engine to accelerate between two given engine speeds, the reduction may be of at least 0.1%, preferably of at least 0.2 or 0.3 or 0.4 or 0.5%, in cases of at least 0.6 or 0.7 or 0.8 or 0.9%, compared to that taken when running the engine on the fuel composition prior to incorporation of the wax anti-settling agent. The reduction may be as compared to the acceleration time between the relevant speeds when the same engine is run on an otherwise analogous fuel composition which is intended (e.g. marketed) for use in an internal combustion (typically diesel) engine prior to adding a wax anti-settling agent to it. Such acceleration times may for instance be measured over an engine speed increase of 300 rpm or more, or of 400 or 500 or 600 or 700 or 800 or 900 or 1000 rpm or more, for example from 1300 to 1600 rpm, or from 1600 to 2200 rpm, or from 2200 to 3000 rpm, or from 3000 to 4000 rpm.

The automotive fuel composition in which the wax anti-settling agent is used, in accordance with the present invention, may in particular be a diesel fuel composition suitable for use in a diesel engine. It may be used in, and/or may be suitable and/or adapted and/or intended for use in, any type of compression ignition engine, for instance those described below.

A suitable WASA for use herein is an oil-soluble polar nitrogen compound in the form of a quaternary ammonium salt of a carboxylic, preferably polycarboxylic, acid. Such a wax anti-settling agent is disclosed in EP-A-2033945 and EP-A-1947161. The nitrogen atom of the ammonium cation carries, for example, four hydrocarbyl groups, The salt is for example monomeric.

As used herein the term "hydrocarbyl" means a group containing carbon and hydrogen atoms that is bonded to the remainder of the molecule via a carbon atom and that may include hetero atoms that do not detract from the essentially hydrocarbon nature of the group.

The quaternary ammonium salt for use herein may be represented by the formula $[NR_2R^{13}R^{14}]X$ wherein R represents a methyl, ethyl or propyl group; $R^{13}$ represents a hydrocarbyl group, such as an alkyl group containing 8 to 40 carbon atoms; $R^{14}$ represents a hydrocarbyl group, such as an alkyl group containing up to 40 carbon atoms; and X represents a monovalent carboxylate anion.

The quaternary ammonium cation in the quarternary ammonium salt compound preferably carries a segment of the formula $NR^{13}R^{14}$, where $R^{13}$ independently represents a hydrocarbyl group, such as an alkyl group, containing from 8 to 40 carbon atoms, and $R^{14}$ independently represents a hydrocarbyl group, such as an alkyl group, containing up to 40 carbon atoms, more preferably from 8 to 40 carbon atoms. $R^{13}$ and $R^{14}$ may be straight chain or branched, and/or may be the same or different.

Preferably each of $R^{13}$ and $R^{14}$ represents a $C_{12}$ to $C_{24}$ straight-chain alkyl group.

In one embodiment, $R^{13}$ represents a $C_{12}$ to $C_{24}$ straight chain alkyl group and $R^{14}$ represents a methyl, ethyl or propyl group.

The quaternary ammonium cation is preferably represented by the formula $+NR^{13}R^{14}R_2$, where R represents an alkyl group having from one to four carbon atoms such as a methyl, ethyl or propyl group.

Suitably, the segment $NR^{13}R^{14}$ is derived from a secondary amine such as di-octadecylamine, di-cocoamine, dihydrogenated tallow amine and methylbehenylamine. The amine may be a mixture such as derived from natural materials, preferably a secondary hydrogenated tallow amine, the alkyl groups of which are derived from hydrogenated tallow fat composed of approximately 4% $C_{14}$, 31% $C_{16}$ and 59% $C_{18}$ alkyl groups, where the percentages are by weight. As an example of tertiary amine that may be used, there may be mentioned a tertiary amine of the formula $NR^{13}R^{14}R$ where $R^{13}$ and $R^{14}$ are defined as above and R represents a methyl, ethyl or propyl group, methyl being preferred.

In one embodiment, examples of suitable carboxylic acids and their esters for preparing the quaternary ammonium salts include oxalic acid, phthalic acid, salicylic acid, maleic acid, malonic acid, citric acid, and 2,4,6-trihydrocybenzoic acid. Dicarboxylic acids are preferred, for example oxalic acid. Esters of the above compounds are preferably methyl esters, for example dimethyl oxalate.

In another embodiment, examples of suitable polycarboxylic acids and their anhydrides for preparing the quaternary ammonium salts include ethylenediamine tetraacetic acid, and carboxylic acids based on cyclic skeletons, e.g. cyclohexane-1,2-dicarboxylic acid, cyclohexene-1,2-dicarboxylic acid, cyclopentane-1,2-dicarboxylic acid and naphthalene dicarboxylic acid, and 1,4-dicarboxylic acids including dialkyl spirobislactones. Generally, these acids have 5 to 13 carbon atoms in the cyclic moiety. Preferred acids useful in the present invention are benzene dicarboxylic acids, e.g. phthalic acid, isophthalic acid, and terephthalic acid. Phthalic acid and its anhydride are particularly preferred.

A particularly preferred quaternary ammonium salt is represented by the formula:

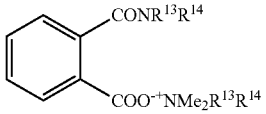

where $R^{13}$ and $R^{14}$ each independently represent alkyl groups derived from hydrogenated tallow fat, which compound may, for example, be made by reacting N,N-dimethyl-N,N-dihydrogenated tallow ammonium chloride (one mole) with dihdrogenated tallow amine (one mole), phthalic anhydride (one mole) and sodium methoxide (one mole).

An example of a suitable wax anti-settling additive is an N,N-dimethyldi-dihydrogenated tallow ammonium salt of 2-(N',N'-dihydrogenated tallow amido) benzoic acid, made by reacting N,N-dimethyl-N,N-dihydrogenated ammonium chloride (one mole) with dehydrogenate tallow amine (one mole), phthalic anhydride (one mole) and sodium methoxide (one mole). Sodium chloride (a by-product) can be separated by washing with water and removing the aqueous solution.

Further details of preparation methods of the wax anti-settling agents can be found in EP-A-2033945 and EP-A-1947161.

An example of a commercially available wax anti-settling agent for use herein is R446, commercially available from Infineum.

The wax anti-settling agent is preferably used in the fuel composition at concentrations in the range from 0.001 wt % (10 ppm) to 0.2 wt % (2000 ppm), more preferably 0.010 wt % (100 ppm) to 0.1 wt % (1000 ppm), even more preferably in the range from 0.010 wt % (100 ppm) to 0.05 wt % (500 ppm), especially in the range from 0.01 wt % (100 ppm) to 0.03 wt % (300 ppm), by weight of the fuel composition.

The remainder of the composition will typically consist of one or more automotive base fuels, for instance as described in more detail below, optionally together with one or more fuel additives.

A fuel composition prepared according to the present invention may be for example an automotive gasoline or diesel fuel composition, in particular the latter.

A gasoline fuel composition prepared according to the present invention may in general be any type of gasoline fuel composition suitable for use in a spark ignition (petrol) engine. It may contain, in addition to the WASA, other standard gasoline fuel components. It may, for example, include a major proportion of a gasoline base fuel, which will typically have a boiling range (ASTM D-86 or EN ISO 3405) of from 20 to 210° C. A "major proportion" in this context means typically 85% w/w or greater based on the overall fuel composition, more suitably 90 or 95% w/w or greater, most preferably 98 or 99 or 99.5% w/w or greater.

A diesel fuel composition prepared according to the present invention may in general be any type of diesel fuel composition suitable for use in a compression ignition (diesel) engine. It may contain, in addition to the VI improving additive, other standard diesel fuel components. It may, for example, include a major proportion of a diesel base fuel, for instance of the type described below. Again a "major proportion" means typically 85% w/w or greater based on the overall composition, more suitably 90 or 95% w/w or greater, most preferably 98 or 99 or 99.5% w/w or greater.

Thus, in addition to the WASA, a diesel fuel composition prepared according to the present invention may comprise one or more diesel fuel components of conventional type. Such components will typically comprise liquid hydrocarbon middle distillate fuel oil(s), for instance petroleum derived gas oils. In general such fuel components may be organically or synthetically derived, and are suitably obtained by distillation of a desired range of fractions from a crude oil. They will typically have boiling points within the usual diesel range of 150 to 410° C. or 170 to 370° C., depending on grade and use. Typically the fuel composition will include one or more cracked products, obtained by splitting heavy hydrocarbons.

A petroleum derived gas oil may for instance be obtained by refining and optionally (hydro)processing a crude petroleum source. It may be a single gas oil stream obtained from such a refinery process or a blend of several gas oil fractions obtained in the refinery process via different processing routes. Examples of such gas oil fractions are straight run gas oil, vacuum gas oil, gas oil as obtained in a thermal cracking process, light and heavy cycle oils as obtained in a fluid catalytic cracking unit and gas oil as obtained from a hydrocracker unit. Optionally a petroleum derived gas oil may comprise some petroleum derived kerosene fraction.

Such gas oils may be processed in a hydrodesulphurisation (HDS) unit so as to reduce their sulphur content to a level suitable for inclusion in a diesel fuel composition.

A diesel base fuel may be or comprise a Fischer-Tropsch derived diesel fuel component, typically a Fischer-Tropsch derived gas oil. In the context of the present invention, the term "Fischer-Tropsch derived" means that a material is, or derives from, a synthesis product of a Fischer-Tropsch condensation process. The term "non-Fischer-Tropsch derived" may be interpreted accordingly. A Fischer-Tropsch derived fuel or fuel component will therefore be a hydrocarbon stream in which a substantial portion, except for added hydrogen, is derived directly or indirectly from a Fischer-Tropsch condensation process.

The Fischer-Tropsch reaction converts carbon monoxide and hydrogen into longer chain, usually paraffinic, hydrocarbons:

$n(CO+2H_2)=(—CH_2-)_n+nH_2O$+heat, in the presence of an appropriate catalyst and typically at elevated temperatures (e.g. 125 to 300° C., preferably 175 to 250° C.) and/or pressures (e.g. 0.5 to 10 MPa, preferably 1.2 to 5 MPa). Hydrogen:carbon monoxide ratios other than 2:1 may be employed if desired.

The carbon monoxide and hydrogen may themselves be derived from organic, inorganic, natural or synthetic sources, typically either from natural gas or from organically derived methane.

A Fischer-Tropsch derived diesel fuel component of use in the present invention may be obtained directly from the refining or the Fischer-Tropsch reaction, or indirectly for instance by fractionation or hydrotreating of the refining or synthesis product to give a fractionated or hydrotreated product. Hydrotreatment can involve hydrocracking to adjust the boiling range (see e.g. GB-B-2077289 and EP-A-0147873) and/or hydroisomerisation which can improve cold flow properties by increasing the proportion of branched paraffins. EP-A-0583836 describes a two-step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired fraction(s), typically gas oil fraction(s), may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. Nos. 4,125,566 and 4,478,955.

Typical catalysts for the Fischer-Tropsch synthesis of paraffinic hydrocarbons comprise, as the catalytically active component, a metal from Group VIII of the periodic table of the elements, in particular ruthenium, iron, cobalt or nickel. Suitable such catalysts are described for instance in EP-A-0583836.

An example of a Fischer-Tropsch based process is the Shell™ "Gas-to-liquids" or "GtL" technology (formerly known as the SMDS (Shell Middle Distillate Synthesis) and described in "The Shell Middle Distillate Synthesis Process", van der Burgt et al, paper delivered at the 5th Synfuels Worldwide Symposium, Washington D.C., November 1985, and in the November 1989 publication of the same title from Shell International Petroleum Company Ltd, London, UK). In the latter case, preferred features of the hydroconversion process may be as disclosed therein. This process produces middle distillate range products by conversion of a natural gas into a heavy long chain hydrocarbon (paraffin) wax which can then be hydroconverted and fractionated.

For use in the present invention, a Fischer-Tropsch derived fuel component is preferably any suitable component derived from a gas to liquid synthesis (hereinafter a GtL component), or a component derived from an analogous Fischer-Tropsch synthesis, for instance converting gas, biomass or coal to liquid (hereinafter an XtL component). A Fischer-Tropsch derived component is preferably a GtL component. It may be a BtL (biomass to liquid) component. In general a suitable XtL component may be a middle distillate fuel component, for instance selected from kerosene, diesel and gas oil fractions as known in the art; such components may be generically classed as synthetic process fuels or synthetic process oils. Preferably an XtL component for use as a diesel fuel component is a gas oil.

Diesel fuel components contained in a composition prepared according to the present invention will typically have a density of from 750 to 900 kg/m$^3$, preferably from 800 to 860 kg/m$^3$, at 15° C. (ASTM D-4052 or EN ISO 3675) and/or a VK 40 of from 1.5 to 6.0 mm$^2$/s (ASTM D-445 or EN ISO 3104).

In a diesel fuel composition prepared according to the present invention, the base fuel may itself comprise a mixture of two or more diesel fuel components of the types described above. It may be or contain a so-called "biodiesel" fuel component such as a vegetable oil, hydrogenated vegetable oil or vegetable oil derivative (e.g. a fatty acid ester, in particular a fatty acid methyl ester) or another oxygenate such as an acid, ketone or ester. Such components need not necessarily be bio-derived.

An automotive diesel fuel composition prepared according to the present invention will suitably comply with applicable current standard specification(s) such as for example EN 590 (for Europe) or ASTM D-975 (for the USA). By way of example, the overall fuel composition may have a density from 820 to 845 kg/m$^3$ at 15° C. (ASTM D-4052 or EN ISO 3675); a T95 boiling point (ASTM D-86 or EN ISO 3405) of 360° C. or less; a measured cetane number (ASTM D-613) of 51 or greater; a VK 40 (ASTM D-445 or EN ISO 3104) from 2 to 4.5 mm$^2$/s; a sulphur content (ASTM D-2622 or EN ISO 20846) of 50 mg/kg or less; and/or a polycyclic aromatic hydrocarbons (PAH) content (IP 391(mod)) of less than 11% w/w. Relevant specifications may, however, differ from country to country and from year to year, and may depend on the intended use of the fuel composition.

A diesel fuel composition prepared according to the present invention suitably contains no more than 5000 ppmw (parts per million by weight) of sulphur, typically from 2000 to 5000 ppmw, or from 1000 to 2000 ppmw, or alternatively up to 1000 ppmw. The composition may, for example, be a low or ultra low sulphur fuel, or a sulphur free fuel, for instance containing at most 500 ppmw, preferably no more than 350 ppmw, most preferably no more than 100 or 50 or even 10 ppmw, of sulphur.

An automotive fuel composition prepared according to the present invention, or a base fuel used in such a composition, may be additivated (additive-containing) or unadditivated (additive-free). If additivated, e.g. at the refinery, it will contain minor amounts of one or more additives selected for example from anti-static agents, pipeline drag reducers, viscosity index improvers (VIIs), flow improvers (e.g. ethylene/vinyl acetate copolymers or acrylate/maleic anhydride copolymers), lubricity additives, antioxidants. Thus, the composition may contain a minor proportion (preferably 1% w/w or less, more preferably 0.5% w/w (5000 ppmw) or less and most preferably 0.2% w/w (2000 ppmw) or less), of one or more fuel additives, in addition to the wax anti-settling agent.

A preferred fuel additive for use herein in combination with the WASA is a cold flow improver, such as a middle distillate flow improver (MDFI). A cold flow improver is any material capable of improving the cold flow properties of a composition.

MDFIs may for example comprise vinyl ester-containing compounds such as vinyl acetate-containing compounds, in particular polymers. Copolymers of alkenes (for example ethylene, propylene or styrene, more typically ethylene) and unsaturated esters (for instance vinyl carboxylates, typically vinyl acetate) are, for instance, known for use as MDFIs.

The MDFI additive is preferably present at a level of from 10 ppm to 500 ppm, more preferably from 0.01 wt % (100 ppm) to 0.05 wt % (500 ppm), even more preferably from 0.015 wt % to 0.04 wt %, by weight of the fuel composition.

Examples of MDFI's suitable for use herein include R347 and R309 commercially available from Infineum.

The fuel composition herein may comprise a viscosity index improver (VII). Suitable VIIs for use herein include those disclosed in WO2009/118302, incorporated herein by reference.

The VI improving additive used in a fuel composition in accordance with the present invention may be polymeric in nature. It may, for example, be selected from:

a) styrene-based copolymers, in particular block copolymers, for example those available as Kraton™ D or Kraton™ G additives (ex. Kraton) or as SV™ additives (ex. Infineum, Multisol or others). Particular examples include copolymers of styrenic and ethylene/butylene monomers, for instance polystyrene-polyisoprene copolymers and polystyrene-polybutadiene copolymers. Such copolymers may be block copolymers, as for instance SV™ 150 (a polystyrene-polyisoprene di-block copolymer) or the Kraton™ additives (styrene-butadiene-styrene tri-block copolymers or styrene-ethylene-butylene block copolymers). They may be tapered copolymers, for instance styrene-butadiene copolymers. They may be stellate copolymers, as for instance SV™ 260 (a styrene-polyisoprene star copolymer);

b) other block copolymers based on ethylene, butylene, butadiene, isoprene or other olefin monomers, for example ethylene-propylene copolymers;

c) polyisobutylenes (PIBs);

d) polymethacrylates (PMAs);

e) poly alpha olefins (PAOs); and f) mixtures thereof.

Of the above, additives of type (a) and (b), or mixtures thereof, may be preferred, in particular additives of type (a). VI improving additives which contain, or ideally consist essentially of, block copolymers, may be preferred, as in general these can lead to fewer side effects such as increases in deposit and/or foam formation.

The VI improving additive may, for example, comprise a block copolymer which contains one or more olefin monomer blocks, typically selected from ethylene, propylene, butylene, butadiene, isoprene and styrene monomers.

Preferred VIIs for use herein include SV150 and SV160 commercially available from Infineum.

The kinematic viscosity at 40° C. (VK 40, as measured by ASTM D-445 or EN ISO 3104) of the VI improving additive is suitably 40 mm$^2$/s or greater, preferably 100 mm$^2$/s or greater, more preferably 1000 mm$^2$/s or greater. Its density at 15° C. (ASTM D-4052 or EN ISO 3675) is suitably 600 kg/m$^3$ or greater, preferably 800 kg/m$^3$ or greater. Its sulphur content (ASTM D-2622 or EN ISO 20846) is suitably 1000 mg/kg or lower, preferably 350 mg/kg or lower, more preferably 10 mg/kg or lower.

The VI improving additive may be pre-dissolved in a suitable solvent, for example an oil such as a mineral oil or Fischer-Tropsch derived hydrocarbon mixture; a fuel component (which again may be either mineral or Fischer-Tropsch derived) compatible with the fuel composition in which the additive is to be used (for example a middle distillate fuel component such as a gas oil or kerosene, when intended for use in a diesel fuel composition); a poly alpha olefin; a so-called biofuel such as a fatty acid alkyl ester (FAAE), a Fischer-Tropsch derived biomass-to-liquid synthesis product, a hydrogenated vegetable oil, a waste or algae oil or an alcohol such as ethanol; an aromatic solvent; any other hydrocarbon or organic solvent; or a mixture thereof. Preferred solvents for use in this context are mineral oil based diesel fuel components and solvents, and Fischer-Tropsch derived components such as the "XtL" components referred to below. Biofuel solvents may also be preferred in certain cases.

The concentration of the VI improving additive in the fuel composition may be up to 1% w/w, suitably up to 0.5% w/w, in cases up to 0.4 or 0.3 or 0.25% w/w. It may be 0.001% w/w or greater, preferably 0.01% w/w or greater, suitably 0.02 or 0.03 or 0.04 or 0.05% w/w or greater, in cases 0.1 or 0.2% w/w or greater. Suitable concentrations may for instance be from 0.001 to 1% w/w, or from 0.001 to 0.5% w/w, or from 0.05 to 0.5% w/w, or from 0.05 to 0.25% w/w, for example from 0.05 to 0.25% w/w or from 0.1 to 0.2% w/w. Surprisingly it has been found that higher concentrations of VI improving additives (for instance, higher than 0.5% w/w) do not always lead to improved engine performance, and that in cases there may be an optimum concentration for any given additive, for instance between 0.05 and 0.5% w/w or between 0.05 and 0.25% w/w or between 0.1 and 0.2% w/w.

In one embodiment of the present invention the viscosity index improver (VII) additive is present at a level of from 50 ppm to 1000 ppm, preferably from 100 ppm to 500 ppm, by weight of the fuel composition.

As described above, the present invention has the advantage that lower levels of VII additives may need to be used in order to get the desired level of engine performance. In a preferred embodiment herein, the fuel composition is free of VII improvers.

The fuel composition may contain a detergent. Detergent-containing diesel fuel additives are known and commercially available. Such additives may be added to diesel fuels at levels intended to reduce, remove or slow the build up of engine deposits.

Examples of detergents suitable for use in fuel additives for the present purpose include polyolefin substituted succinimides or succinamides of polyamines, for instance polyisobutylene succinimides or polyisobutylene amine succinamides, aliphatic amines, Mannich bases or amines and polyolefin (e.g. polyisobutylene) maleic anhydrides. Succinimide dispersant additives are described for example in GB-A-960493, EP-A-0147240, EP-A-0482253, EP-A-0613938, EP-A-0557516 and WO-A-98/42808. Particularly preferred are polyolefin substituted succinimides such as polyisobutylene succinimides.

A fuel additive mixture useable in a fuel composition prepared according to the present invention may contain other components in addition to the detergent. Examples are viscosity index improvers (VII's); lubricity enhancers; dehazers, e.g. alkoxylated phenol formaldehyde polymers; anti-foaming agents (e.g. polyether-modified polysiloxanes); ignition improvers (cetane improvers) (e.g. 2-ethylhexyl nitrate (EHN), cyclohexyl nitrate, di-tert-butyl peroxide and those disclosed in U.S. Pat. No. 4,208,190 at column 2, line 27 to column 3, line 21); anti-rust agents (e.g. a propane-1,2-diol semi-ester of tetrapropenyl succinic acid, or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid); corrosion inhibitors; reodorants; anti-wear additives; antioxidants (e.g. phenolics such as 2,6-di-tert-butylphenol, or phenylenediamines such as N,N'-di-sec-butyl-p-phenylenediamine); metal deactivators; combustion improvers; static dissipator additives; and cold flow improvers.

Such a fuel additive mixture may contain a lubricity enhancer, especially when the fuel composition has a low (e.g. 500 ppmw or less) sulphur content. In the additivated fuel composition, the lubricity enhancer is conveniently present at a concentration of less than 1000 ppmw, preferably between 50 and 1000 ppmw, more preferably between 70 and 1000 ppmw. Suitable commercially available lubricity enhancers include ester- and acid-based additives. Other lubricity enhancers are described in the patent literature, in particular in connection with their use in low sulphur content diesel fuels, for example in:

- the paper by Danping Wei and H. A. Spikes, "The Lubricity of Diesel Fuels", Wear, III (1986) 217-235;
- WO-A-95/33805—cold flow improvers to enhance lubricity of low sulphur fuels;
- WO-A-94/17160—certain esters of a carboxylic acid and an alcohol wherein the acid has from 2 to 50 carbon atoms and the alcohol has 1 or more carbon atoms, particularly glycerol monooleate and di-isodecyl adipate, as fuel additives for wear reduction in a diesel engine injection system;
- U.S. Pat. No. 5,490,864—certain dithiophosphoric diester-dialcohols as anti-wear lubricity additives for low sulphur diesel fuels; and
- WO-A-98/01516—certain alkyl aromatic compounds having at least one carboxyl group attached to their aromatic nuclei, to confer anti-wear lubricity effects particularly in low sulphur diesel fuels.

It may also be preferred for the fuel composition to contain an anti-foaming agent, more preferably in combination with an anti-rust agent and/or a corrosion inhibitor and/or a lubricity enhancing additive.

Unless otherwise stated, the (active matter) concentration of each such additive component in the additivated fuel composition is preferably up to 10000 ppmw, more preferably in the range of 0.1 to 1000 ppmw, advantageously from 0.1 to 300 ppmw, such as from 0.1 to 150 ppmw.

The (active matter) concentration of any dehazer in the fuel composition will preferably be in the range from 0.1 to 20 ppmw, more preferably from 1 to 15 ppmw, still more preferably from 1 to 10 ppmw, advantageously from 1 to 5 ppmw. The (active matter) concentration of any ignition improver present will preferably be 2600 ppmw or less, more preferably 2000 ppmw or less, conveniently from 300 to 1500 ppmw. The (active matter) concentration of any detergent in the fuel composition will preferably be in the range from 5 to 1500 ppmw, more preferably from 10 to 750 ppmw, most preferably from 20 to 500 ppmw.

If desired, one or more additive components, such as those listed above, may be co-mixed—preferably together with suitable diluent(s)—in an additive concentrate, and the additive concentrate may then be dispersed into a base fuel or fuel composition. The WASA may, in accordance with the present invention, be incorporated into such an additive formulation.

In the case of a diesel fuel composition, for example, the fuel additive mixture will typically contain a detergent, optionally together with other components as described above, and a diesel fuel-compatible diluent, which may be a mineral oil, a solvent such as those sold by Shell companies under the trade mark "SHELLSOL", a polar solvent such as an ester and, in particular, an alcohol, e.g. hexanol, 2-ethylhexanol, decanol, isotridecanol and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available.

The total content of the additives in the fuel composition may be suitably between 0 and 10000 ppmw and preferably below 5000 ppmw.

In this specification, amounts (concentrations, % v/v, ppmw, % w/w) of components are of active matter, i.e. exclusive of volatile solvents/diluent materials.

Different types and/or concentrations of additives may be appropriate for use in gasoline fuel compositions, which for example may contain polyisobutylene/amine and/or polyisobutylene/amide copolymers as detergent additives.

In the context of the present invention, "use" of a WASA in a fuel composition means incorporating the WASA into the composition, typically as a blend (i.e. a physical mixture) with one or more fuel components (typically diesel base fuels) and optionally with one or more fuel additives. The WASA is conveniently incorporated before the composition is introduced into an engine which is to be run on the composition. Instead or in addition the use may involve running an engine on the fuel composition containing the WASA, typically by introducing the composition into a combustion chamber of the engine.

"Use" of a WASA, in accordance with the present invention, may also embrace supplying such an additive together with instructions for its use in an automotive fuel composition to achieve one or more of the purpose(s) described above, in particular to improve the acceleration performance of an internal combustion (typically diesel) engine into which the composition is, or is intended to be, introduced.

The WASA may itself be supplied as a component of a formulation which is suitable for and/or intended for use as a fuel additive, in particular a diesel fuel additive, in which case the WASA may be included in such a formulation for the purpose of influencing its effects on the viscosity of an automotive fuel composition, and/or its effects on the acceleration performance of an engine into which a fuel composition is, or is intended to be, introduced.

Thus, the WASA may be incorporated into an additive formulation or package along with one or more other fuel additives. It may, for instance, be combined, in an additive formulation, with one or more fuel additives selected from detergents, anti-corrosion additives, esters, poly alpha olefins, long chain organic acids, components containing amine or amide active centres, and mixtures thereof. In particular, it may be combined with one or more so-called performance additives, which will typically include at least a detergent.

The WASA may be dosed directly into a fuel component or composition, for example at the refinery. It may be pre-diluted in a suitable fuel component which subsequently forms part of the overall automotive fuel composition.

In accordance with the present invention, two or more WASAs may be used in an automotive fuel composition for the purpose(s) described above.

According to a further aspect of the present invention, there is provided a process for the preparation of an automotive fuel composition, which process involves blending an automotive base fuel with a WASA. The blending may be carried out for one or more of the purposes described above in connection with the present invention, in particular with respect to its effect on the acceleration performance of an internal combustion engine into which it is, or is intended to be, introduced. The composition may in particular be a diesel fuel composition.

The WASA may, for example, be blended with other components of the composition, in particular the base fuel, at the refinery. Alternatively, it may be added to an automotive fuel composition downstream of the refinery. It may be added as part of an additive package which contains one or more other fuel additives.

A further aspect of the present invention provides a method of operating an internal combustion engine, and/or a vehicle which is powered by such an engine, which method involves introducing into a combustion chamber of the engine a fuel composition prepared in accordance with the present invention. Again the fuel composition is preferably introduced for one or more of the purposes described in connection with the present invention. Thus, the engine is preferably operated with the fuel composition for the purpose of improving its acceleration performance.

Again the engine may in particular be a diesel engine. It may be a turbo charged engine, in particular a turbo charged diesel engine. The diesel engine may be of the direct injection type, for example of the rotary pump, in-line pump, unit pump, electronic unit injector or common rail type, or of the indirect injection type. It may be a heavy or a light duty diesel engine. It may in particular be an electronic unit direct injection (EUDI) engine.

Throughout the description and claims of this specification, the words "comprise" and "contain" and variations of the words, for example "comprising" and "comprises", mean "including but not limited to", and do not exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Preferred features of each aspect of the present invention may be as described in connection with any of the other aspects.

Other features of the present invention will become apparent from the following examples. Generally speaking, the present invention extends to any novel one, or any novel combination, of the features disclosed in this specification (including any accompanying claims and drawings). Thus features, integers, characteristics, compounds, chemical moieties or groups described in conjunction with a particular aspect, embodiment or example of the present invention are to be understood to be applicable to any other aspect, embodiment or example described herein unless incompatible therewith.

Moreover, unless stated otherwise, any feature disclosed herein may be replaced by an alternative feature serving the same or a similar purpose.

The following examples illustrate the properties of automotive fuel compositions prepared according to the present invention, and assess the effects of such compositions on the performance of a diesel engine.

EXAMPLES

Five fuels were subjected to engine testing to measure their effect on acceleration and power performance in a diesel engine. One of the fuels was a reference fuel, namely a Swedish Class 1 EN590 Diesel B7 fuel (containing 7% FAME). The Swedish class 1 fuel was chosen as a reference fuel because it did not contain any cold flow improvers already. The candidate fuels (Examples A-D) used the same reference fuel with the addition of various types and levels of additives, as shown in Table 1 below.

TABLE 1

| Example | Description |
|---|---|
| Reference Fuel | Swedish Class 1 EN590 B7 |
| Candidate Fuel A | Swedish Class 1 EN590 B7 with 2000 ppm VII (SV150)[1] |
| Candidate Fuel B | Swedish Class 1 EN590 B7 with 300 ppm MDFI cold flow improver (R347)[2] |
| Candidate Fuel C | Swedish Class 1 EN590 B7 with 300 ppm MDFI (R309)[3] and 150 ppm wax anti-settling agent (WASA) (R446)[4] |
| Candidate Fuel D | Swedish Class 1 with 2000 ppm VII (SV150)[1], 300 ppm MDFI (R309)[3] and 150 ppm WASA (R446)[4] |

[1]SV150 is a viscosity index improver commercially available from Infineum.
[2]R347 is a middle distillate flow improver (MDFI) commercially available from Infineum.
[3]R309 is a middle distillate flow improver (MDFI) commercially available from Infineum.
[4]R446 is wax anti-settling agent commercially available from Infineum.

The chemical composition of the R347 and R309 MDFIs used in the present Examples is essentially identical, as evidenced by FTIR.

The reference fuel and Candidate fuels A-D had the fuel properties shown in Table 2 below.

TABLE 2

| Fuel Properties | | | | | | | |
|---|---|---|---|---|---|---|---|
| | | | Fuel Sample: | | | | |
| | unit | method | Ref. Fuel | A | B | C | D |
| density | kg/m3 | DIN EN ISO12185 | 819.6 | 820.5 | 819.6 | 819.6 | 820.5 |
| Viscosity @40° C. | $mm/s^2$ | DIN EN ISO 3104 | 2.183 | 2.324 | 2.082 | 2.082 | 2.623 |
| Viscosity @100° C. | | | 0.9630 | 1.040 | 0.9627 | 0.9631 | 1.059 |
| Viscosity @15° C. | $mm/s^2$ | ASTM D7042 | 3.431 | 3.824 | 3.473 | 3.433 | 3.941 |
| SEDAB | s | DGMK 531 | 51 | 54 | 49 | 56 | 60 |
| filterability test | mL | | 500 | 500 | 500 | 500 | 500 |
| Filterability test | | IP387 | | | | | |
| FBT | | | 1.03 | 1.11 | 1.02 | 1.03 | 1.04 |
| Procedure* | | | B | B | B | B | B |
| Volume | ml | | 300 | 300 | 300 | 300 | 300 |
| Pressure | kPa | | 25 | 50 | 20 | 25 | 30 |

*Procedure B in IP387 means that the sample is kept in a disposable polypropylene housing.

The five fuels were tested on a Euro 5 bench engine under steady state and dynamic conditions. Table 3 below shows the specification for the test engine.

TABLE 3

| Test engine specification | |
|---|---|
| Cylinder/Valves per cylinder | 4/4 (DOHC) |
| Displacement | 2.1968 ltr |
| Max. Power | 103 kW @4200 $min^{-1}$ |
| Max. Torque | 320 Nm @ 1750-2500 $min^{-1}$ |
| Compression | 16.5:1 |
| Engine management | Bosch EDC 17 |
| Emission standard | Euro 5 |
| Injectors | Common Rail Solenoid-operated |
| Air/emissions management | Single stage turbo with VGT and after-cooler, high pressure EGR, DOC and DPF |

FIG. 1 shows the test sequence for the instantaneous power performance test which was carried out on Reference Fuel and Candidate Fuels A-D. Performance test results were split into acceleration measurements (the middle part of the test program in FIG. 1) and torque/power benefits (from the end of FIG. 1). In each data set the benefit of each additivated fuel over the reference fuel was plotted across a range of engine speeds. The full acceleration time from 1500-4000 rpm was split into two speed gates from 1500-2500 rpm and 2500-4000 rpm.

Figure 2:
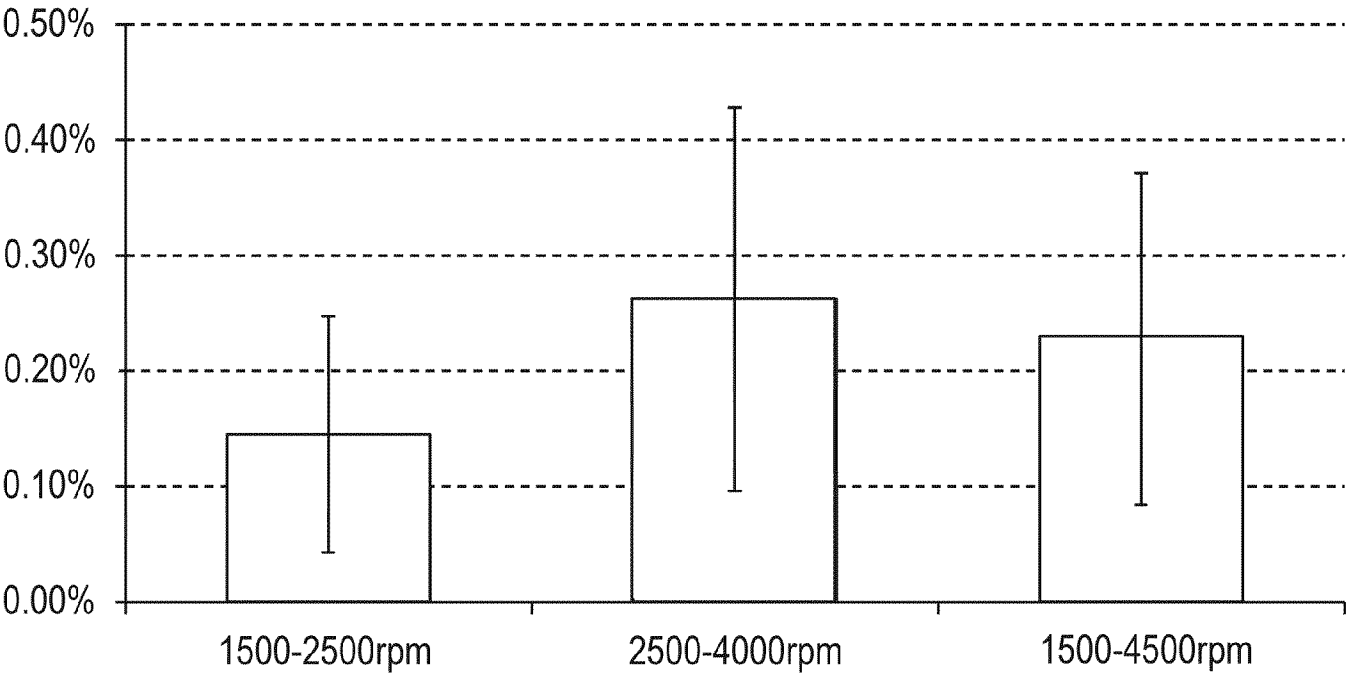
FIG. 2 shows the % acceleration benefit of Candidate Fuel C relative to the Reference Fuel at various engine speeds (as set out in Table 4 below).

Table 4 (and FIG. 2) shows the % acceleration benefit of Candidate Fuel C relative to Reference Fuel at various engine speeds.

TABLE 4

| | Engine Speed: | | |
|---|---|---|---|
| | 1500-2500 rpm | 2500-4000 rpm | 1500-4000 rpm |
| % acceleration benefit of Candidate Fuel C | 0.14%* | 0.26%* | 0.23%* |

*95% confidence level

Figure 3:
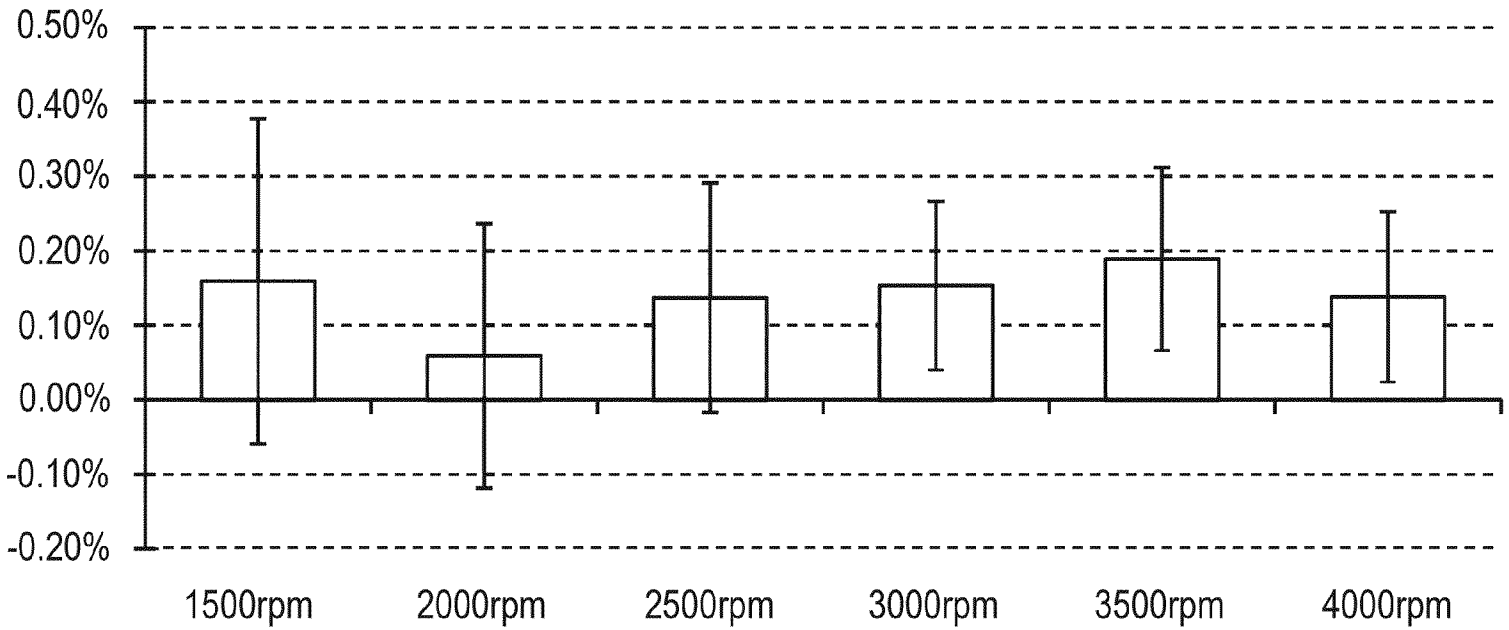
FIG. 3 shows the % power benefit of Candidate Fuel C relative to Reference Fuel at various engines speeds (as set out in Table 5 below).

Table 5 (and FIG. 3) shows the % power benefit of Candidate Fuel C relative to Reference Fuel at various engines speeds.

TABLE 5

| | Engine Speed: | | | | | |
|---|---|---|---|---|---|---|
| | 1500 rpm | 2000 rpm | 2500 rpm | 3000 rpm | 3500 rpm | 4000 rpm |
| % torque benefit of Candidate Fuel C relative to Reference Fuel | 0.16% | 0.06% | 0.14% | 0.15%* | 0.19%* | 0.14%* |

*95% confidence level

Figure 4:
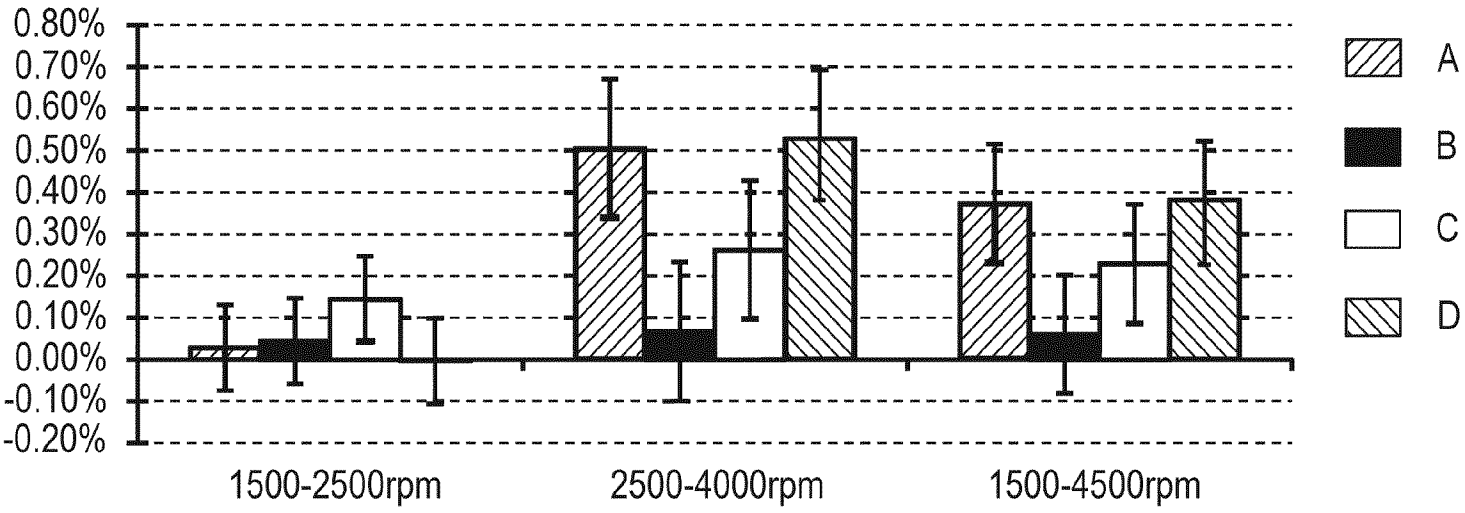
FIG. 4 shows the % acceleration benefits of Candidate Fuels A-D relative to Reference Fuel at various engine speeds (as set out in Table 6).

Table 6 (and FIG. 4) shows the % acceleration benefits of Candidate Fuels A-D relative to Reference Fuel at various engine speeds.

TABLE 6

| | Engine Speed: | | |
|---|---|---|---|
| | 1500-2500 rpm | 2500-4000 rpm | 1500-4000 rpm |
| % acceleration benefit of Candidate Fuel A | 0.03% | 0.51%* | 0.37%* |
| % acceleration benefit of Candidate Fuel B | 0.04% | 0.07% | 0.06% |
| % acceleration benefit of Candidate Fuel C | 0.14%* | 0.26%* | 0.23%* |
| % acceleration benefit of Candidate Fuel D | 0.00% | 0.53%* | 0.38%* |

*95% confidence level

Figure 5:
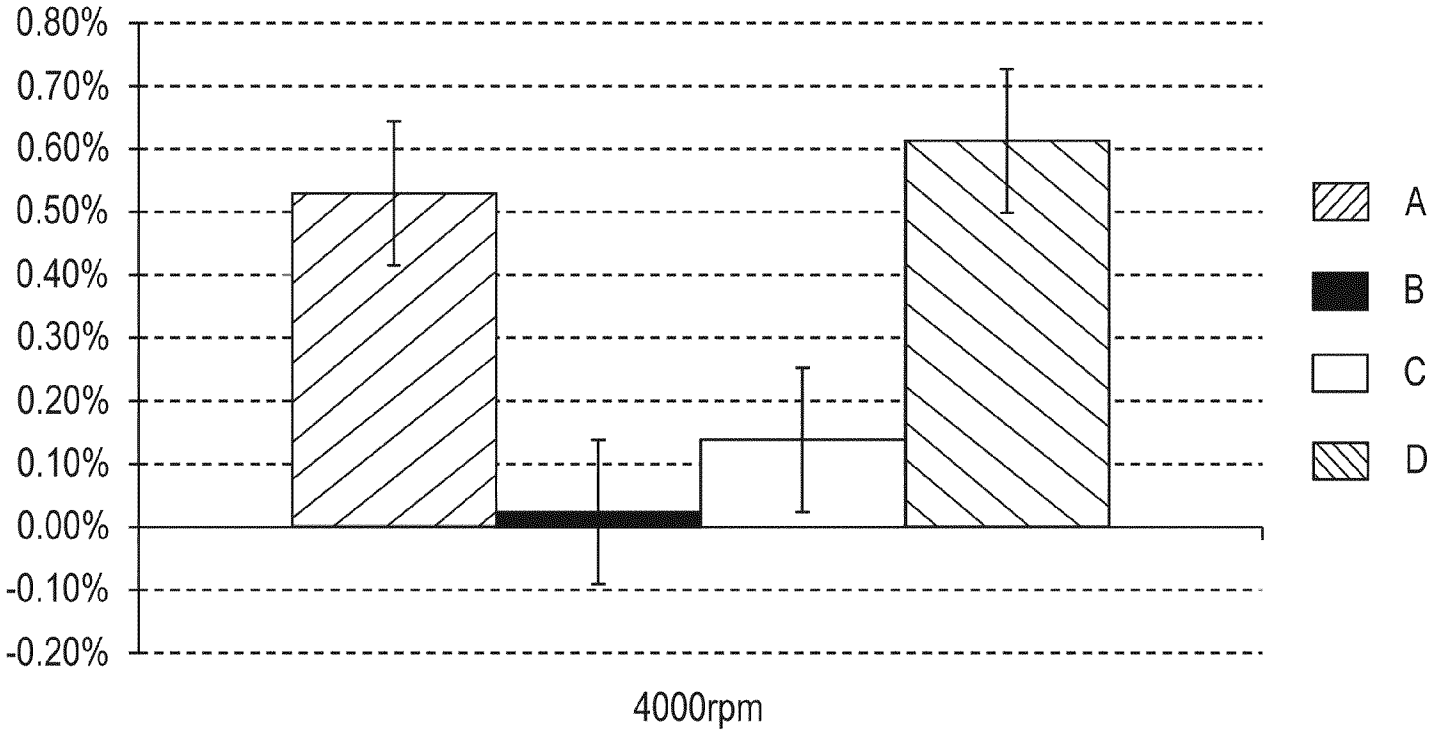
FIG. 5 shows the % torque benefits of Candidate Fuels A-D relative to Reference Fuel at an engine speed of 4000 rpm (as set out in Table 7).

Table 7 (and FIG. 5) shows the % power benefits of Candidate Fuels A-D relative to Reference Fuel at an engine speed of 4000 rpm (which is where the power of an engine is typically rated).

TABLE 7

| | Engine Speed: 4000 rpm |
|---|---|
| % torque benefit of Candidate Fuel A | 0.53%* |
| % torque benefit of Candidate Fuel B | 0.02% |
| & torque benefit of candidate Fuel C | 0.14%* |
| % torque benefit of candidate Fuel D | 0.61%* |

*95% confidence level

Discussion

The results in Tables 4-7 (and FIGS. 2-5) show that the wax anti-settling agent used in Candidate Fuels A-D provides improvements in acceleration and power.

That which is claimed is:

1. A method for improving an acceleration performance of an internal combustion engine, the method comprising:

combusting an automotive diesel fuel composition in an internal combustion engine, the automotive diesel fuel composition comprising:

a wax anti-settling agent (WASA); and a middle distillate flow improver (MDFI), wherein the wax anti-settling agent comprises an oil-soluble polar nitrogen compound in the form of a quaternary ammonium salt of a carboxylic acid wherein the quaternary ammonium salt of a carboxylic acid has the formula $[NR_2R^{13}R^{14}]X$ wherein R represents a methyl, ethyl or propyl group; $R^{13}$ represents a hydrocarbyl group containing from 8 to 40 carbon atoms, and $R^{14}$ represents a hydrocarbyl group containing up to 40 carbon atoms; and X represents a monovalent carboxylate anion, wherein the MDFI comprises one or more of a vinyl acetate-containing compound, a vinyl acetate-containing polymer, and a copolymer of alkenes and unsaturated esters, wherein the concentration of the wax anti-settling agent in the automotive diesel fuel composition is in the range from 100 ppm to 500 ppm by weight of the automotive diesel fuel composition, and wherein the MDFI additive is present at a level of from 100 ppm to 500 ppm, by weight of the automotive diesel fuel composition.

2. The method according to claim 1, wherein each of $R^{13}$ and $R^{14}$ represents a $C_{12}$ to $C_{24}$ straight chain alkyl group.

3. The method according to claim 1, wherein $R^{13}$ and optionally $R^{14}$ represent alkyl groups derived from hydrogenated tallow fat.

4. The method according to claim 1, wherein $R^{13}$ represents a methyl, ethyl or propyl group and $R^{14}$ represents a $C_{12}$ to $C_{24}$ straight-chain alkyl group.

5. The method according to claim 1, wherein the carboxylic acid is a dicarboxylic acid.

6. The method according to claim 5, wherein the dicarboxylic acid is oxalic acid or phthalic acid.

7. The method according to claim 1, wherein the automotive fuel composition comprises a viscosity index improver (VII) additive.

8. The method according to claim 7, wherein the viscosity index improver (VII) additive is present at a level of from 50 ppm to 1000 ppm by weight of the automotive fuel composition.

9. The method according to claim 1, wherein the automotive fuel composition is free of viscosity index improver (VII) additive.

10. The method according to claim 1, wherein the acceleration performance of the internal combustion engine is improved one or more of:

0.14% at 1,500 rpm to 2,500 rpm, 0.26% at 2,500 rpm to 4,000 rpm, and 0.23% at 1,500 rpm to 4,000 rpm, in comparison to an analogous fuel composition not containing a WASA and a MDFI.

11. The method according to claim 1, wherein a torque performance of the internal combustion engine is improved by at least 0.1%, or at least 0.2%, or at least 0.3%, or at least 0.4%, or at least 0.5%, or at least 0.6%, or at least 0.7%, in comparison to an analogous fuel composition not containing a WASA and a MDFI.

12. The method according to claim 1, wherein a torque performance of the internal combustion engine is improved one or more of:

0.16% at 1,500 rpm, 0.06% at 2,000 rpm, 0.14% at 2,500 rpm, 0.15% at 3,000 rpm, 0.19% at 3,500 rpm, and 0.14% at 4,000 rpm, in comparison to an analogous fuel composition not containing a WASA and a MDFI.

* * * * *